US007243502B2

(12) United States Patent
Umemura et al.

(10) Patent No.: US 7,243,502 B2
(45) Date of Patent: Jul. 17, 2007

(54) CONTROL SYSTEM FOR VARIABLE DISPLACEMENT COMPRESSOR

(75) Inventors: Satoshi Umemura, Kariya (JP); Yuji Hashimoto, Kariya (JP); Ryo Matsubara, Kariya (JP); Masakazu Murase, Kariya (JP); Tatsuya Koide, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 317 days.

(21) Appl. No.: 10/741,726

(22) Filed: Dec. 18, 2003

(65) Prior Publication Data

US 2004/0129009 A1 Jul. 8, 2004

(30) Foreign Application Priority Data

Dec. 19, 2002 (JP) ..... 2002-368496

(51) Int. Cl.
*F25B 1/00* (2006.01)
*F04B 1/26* (2006.01)

(52) U.S. Cl. ..... 62/228.3; 417/222.2

(58) Field of Classification Search ..... 62/228.1, 62/228.3, 228.4, 228.5, 229; 417/222.2
See application file for complete search history.

(56) References Cited

U.S. PATENT DOCUMENTS 5,385,029 A 1/1995 Yamanaka et al. ..... 62/133
6,484,523 B2 * 11/2002 Kuroda et al. ..... 62/228.3
6,520,749 B2 * 2/2003 Kimura et al. ..... 417/222.2

FOREIGN PATENT DOCUMENTS

| | | |
|---|---|---|
| EP | 0 427 828 A1 | 11/1990 |
| EP | 1 074 800 A2 | 2/2001 |
| EP | 1 091 125 | 4/2001 |
| EP | 1 207 302 | 5/2002 |
| JP | 09-280171 | 10/1997 |
| JP | 11-159448 | 6/1999 |
| JP | 2002-219932 | 8/2002 |

OTHER PUBLICATIONS

European Search Report (dated Nov. 28, 2006).

* cited by examiner

*Primary Examiner*—Chen Wen Jiang
(74) *Attorney, Agent, or Firm*—Morgan & Finnegan, L.L.P.

(57) ABSTRACT

In a control system of a variable displacement compressor, a pressure sensing means mechanically detects at least one pressure in the refrigerant circuit. A varying means varies a reference value for positioning a valve body. A pressure detector electrically detects the pressure detected by the pressure sensing means in the refrigerant circuit and/or physical quantity which correlates with the detected pressure. A calculator calculates a maximum value of urging force applied to the valve body by the varying means toward an increasing side of the displacement of the compressor. The urging force applied to the valve body is controlled not to exceed the maximum value toward the increasing side of the displacement. The displacement of the compressor is maximized by the pressure sensing means under the pressure for calculating the maximum value when the varying means applies urging force of the maximum value to the valve body.

15 Claims, 5 Drawing Sheets

CONTROL SYSTEM FOR VARIABLE DISPLACEMENT COMPRESSOR

BACKGROUND OF THE INVENTION

The present invention relates to a control system for adjusting displacement of a variable displacement compressor of a refrigerant circuit (a refrigeration cycle) in an air conditioner and is configured to optionally vary the displacement, while refrigerant gas is compressed by rotation of a drive shaft of the compressor.

As disclosed in page 7 to 11 and FIG. 3 of Unexamined Japanese Patent Publication No. 2001-173556, a control system of the above type includes an external control valve having an electromagnetic actuator in a pressure sensing valve. Namely, the external control valve includes a valve body, a pressure sensing member and the electromagnetic actuator. The valve body optionally adjusts the opening degree of a supply passage that interconnects a discharge chamber of a variable displacement swash plate type compressor (hereinafter, the compressor) and a crank chamber, which is an accommodating chamber for accommodating a swash plate of the compressor. The pressure sensing member mechanically detects pressure difference between two pressure monitoring points located in a discharge pressure region in a refrigerant circuit. The pressure difference between the above two points reflects the flow rate of refrigerant in the refrigerant circuit. The pressure sensing member moves the valve body in such a manner that the displacement of the compressor is varied to cancel the variation n of the pressure difference between the above two points, that is, the variation of the flow rate of refrigerant.

The above electromagnetic actuator varies electromagnetic urging force (particularly, urging force that resists against urging force applied to the valve body by the pressure sensing member in a direction to open the valve) applied to the valve body in a direction to close the valve by electric power externally supplied so that a set pressure difference between the two pressure monitoring points is optionally varied. Incidentally, the set pressure difference is a reference value for positioning the valve body by the pressure sensing member. Namely, for example, as the electric power externally supplied to the electromagnetic actuator increases, the electromagnetic actuator strengthens the electromagnetic urging force applied to the valve body and increases the set pressure difference. On the contrary, as the electric power externally supplied to the electromagnetic actuator decreases, the electromagnetic actuator weakens the electromagnetic urging force applied to the valve body and decreases the set pressure difference.

The flow rate of refrigerant in the refrigerant circuit positively correlates with the displacement of the compressor and the rotational speed of the vehicle engine for driving the compressor. Generally, the maximum value of the set pressure difference, that is, the maximum value of the electromagnetic urging force applied to the valve body by the electromagnetic actuator, is predetermined at a flow rate of refrigerant that is optionally performed in a state when the displacement of the compressor is maximum and the engine is rotated in a range of regular rotational speed. Accordingly, even if the displacement of the compressor is maximum, the flow rate of refrigerant corresponding to the maximum set pressure difference is impossibly performed in a state when the engine is rotated in a range of relatively low rotational speed, which is close to an idling of the engine.

An unwanted feature is that in a prior art since the rotational speed of the engine is not reflected to calculate the set pressure difference (the magnitude of electric power supplied to the electromagnetic actuator), the impossibly performed flow rate of refrigerant between the two pressure monitoring points is possibly ordered to the electromagnetic actuator in a state when the engine is rotated at a range of relatively low rotational speed. Accordingly, for example, when cooling is required, the set pressure difference ordered to the electromagnetic actuator largely deviates from the optionally performed pressure difference between the two pressure monitoring points at the moment in such a manner that the set pressure difference is greater than the pressure difference between the two pressure monitoring points.

Even if the rotational speed of th compressor rapidly increases due to th rapid acceleration of the vehicle and tends to increase the flow rat of refrigerant in the refrigerant circuit in the above state, the valve body cannot leave from a fully-closed state until the flow rate of refrigerant increases to correspond to the set pressure difference ordered to the electromagnetic actuator. Accordingly, it takes a relatively long time to initiate to leave from the maximum displacement of the compressor after the engine commences rapid increasing in rotational speed. As a result, discharge pressure of the compressor excessively increases so that a problem, such as a trouble with the compressor or with a conduit of the refrigerant circuit, has occurred.

Not only the above problem occurs in the control valve that has the pressure sensing member to sense the pressure difference between the two monitoring points in the refrigerant circuit, but also a similar problem occurs in a control valve that has a pressure sensing member to move by detecting at least one kind of pressure in the refrigerant circuit. Namely, for example, even if a control valve optionally varies set suction pressure in such a manner that the pressure sensing member senses pressure in a suction pressure region in the refrigerant circuit, the set suction pressure ordered to the electromagnetic actuator is possibly set to an excessively low value that is impossibly performed in the state of relatively low rotational speed of the engine at the moment when cooling is required.

Incidentally, a relief valve may be arranged in a discharge pressure region or a means may be employed for decreasing the displacement of the compressor by detecting acceleration of the vehicle through an acceleration pedal and the like. However, when the relief valve is applied, the relief valve needs be exclusive so that the number of components increases. When the means for decreasing the displacement of the compressor is applied, in a state when discharge pressure just before rapid acceleration of the vehicle is relatively high, an external control after detecting the rapid acceleration is so late that the discharge pressure excessively increases. Therefore, there is a need for a control system that immediately decreases the displacement of a compressor from the maximum and prevents an excessive increase in discharge pressure when rotational speed of the compressor rapidly increases.

SUMMARY OF THE INVENTION

In accordance with the present invention, a control system for use in a variable displacement compressor of a refrigerant circuit in an air conditioner has a control valve, a pressure detector, a calculator and a controller. The control valve includes a valve body, a pressure sensing means and a varying means. The pressure sensing means mechanically detects at least one pressure of plural kinds of pressure in the refrigerant circuit and moves the valve body in such a manner that the displacement of the compressor is varied to cancel variation of a detected pressure detected by the pressure sensing means. The varying means varies a reference value for positioning the valve body by the pressure sensing means. The pressure detector electrically detects the pressure detected by the pressure sensing means in the refrigerant circuit and/or physical quantity which correlates with the pressure detected by the pressure sensing means in the refrigerant circuit. The calculator calculates a maximum value which is a variation limit of urging force applied to the valve body by the varying means toward an increasing side of the displacement of the compressor. The controller controls the varying means in such a manner that the urging force applied to the valve body does not exceed the maximum value toward the increasing side of the displacement of the compressor. The displacement of the compressor is maximized by the pressure sensing means under the pressure for calculating the maximum value when the varying means applies urging force of the maximum value to the valve body.

Furthermore, the present invention provides a method for controlling a control valve for use in a variable displacement compressor of a refrigerant circuit in an air conditioner of a vehicle. The compressor compresses refrigerant by rotation of a drive shaft of the compressor, while displacement of the compressor is optionally varied by the control valve. The control valve has a solenoid portion which is externally controlled by means of a duty control. The method includes detecting at least one pressure of plural kinds of pressure in the refrigerant circuit and/or physical quantity which correlates with at least one pressure of plural kinds of pressure in the refrigerant circuit, calculating a maximum duty ratio for the duty control based upon a value detected at the detecting step, further detecting temperature in a passenger compartment of the vehicle, obtaining set temperature for the passenger compartment, further calculating a duty ratio for the duty control based upon the detected temperature and the obtained set temperature, actuating the solenoid portion by the maximum duty ratio when the calculated duty ratio is greater than the maximum duty ratio, and actuating the solenoid portion by the calculated duty ratio when the calculated duty ratio is equal to or smaller than the maximum duty ratio.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A preferred embodiment of the present invention will now be described with reference to FIGS. 1 through 6C.

A vehicle air conditioner will now be described at the beginning.

Figure 1:
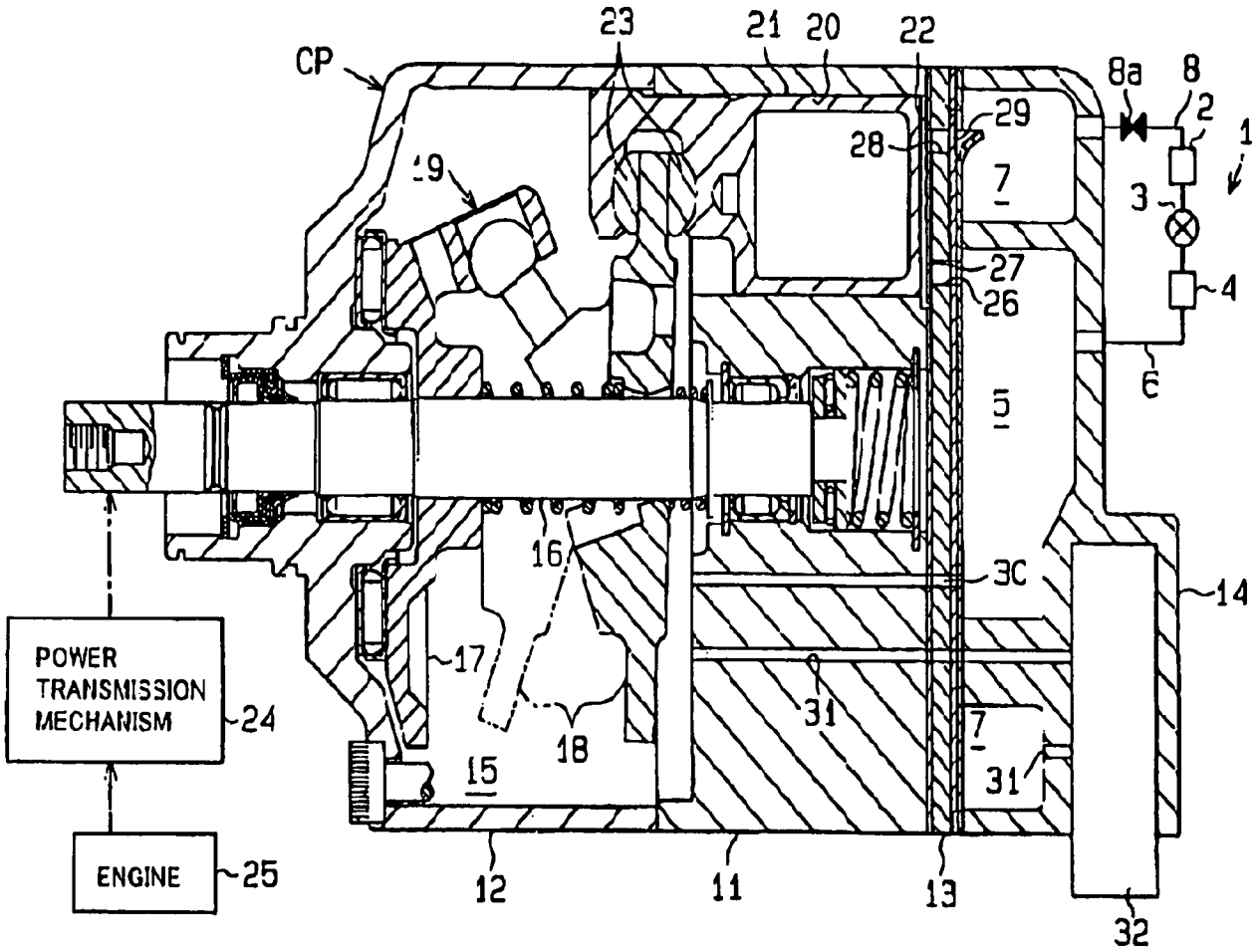
FIG. 1 is a schematic longitudinal cross-sectional view of a variable displacement compressor according to a preferred embodiment of the present invention.

FIG. 1 illustrates a schematic longitudinal cross-sectional view of a variable displacement compressor CP according to a preferred embodiment of the present invention. A refrigerant circuit (refrigeration cycle) of the vehicle air conditioner includes the variable displacement compressor CP (hereinafter the compressor CP) and an external refrigerant circuit 1. The compressor CP has a suction chamber 5 and a discharge chamber 7. The external refrigerant circuit 1, for example, includes a gas cooler 2, an expansion valve 3, an evaporator 4, a first conduit 6 and a second conduit 8. The first conduit 6 interconnects an outlet of the evaporator 4 and the suction chamber 5 for flowing refrigerant gas. The second conduit 8 interconnects the discharge chamber 7 and the gas cooler 2. A fixed throttle 8*a* is provided in the second conduit 8. Incidentally, the preferred embodiment employs carbon dioxide as refrigerant.

The compressor CP introduces the refrigerant gas that is introduced from the evaporator 4 to the suction chamber 5 through the first conduit 6, compresses the refrigerant gas and discharges the compressed refrigerant gas to the discharge chamber 7. The compressed refrigerant gas in the discharge chamber 7 is sent to the gas cooler 2 through the second conduit 8.

The compressor CP will now be described. The left side and the right side respectively correspond to the front side and the rear side of the compressor CP in FIG. 1. A housing of the compressor CP includes a cylinder block 11, a front housing 12 and a rear housing 14. The front housing 12 is fixedly connected to the front end of the cylinder block 11. The rear housing 14 is fixedly connected to the rear end of the cylinder block 11 through a valve port assembly 13.

A crank chamber 15 is defined in a space surrounded by the cylinder block 11 and the front housing 12. A drive shaft 16 is rotatably supported by the cylinder block 11 and the front housing 12 so as to extend through the crank chamber 15. A lug plate 17 is fixedly connected to the drive shaft 16 in the crank chamber 15 so as to rotate integrally with the drive shaft 16.

A swash plate or a cam plate 18 is accommodated in the crank chamber 15. The swash plate 18 is supported by the drive shaft 16 so as to be slidable and inclinable relative to the drive shaft 16. A hinge mechanism 19 is interposed between the lug plate 17 and the swash plate 18. Accordingly, since the swash plate 18 is coupled to the lug plate 17 through the hinge mechanism 19 and is supported by the drive shaft 16, the swash plate 18 synchronously rotates with the lug plate 17 and the drive shaft 16 and is also inclinable relative to the drive shaft 16 in accordance with sliding in an axial direction of the drive shaft 16.

A plurality of cylinder bores 20 (only one of them shown in FIG. 1) is defined in the cylinder block 11 so as to surround the drive shaft 16. A single-headed piston 21 is accommodated in each cylinder bore 20 so as to reciprocate. Compression chambers 22 are defined in each of the cylinder bores 20, which vary in volume in accordance with the reciprocation of the respective pistons 21. Each of the pistons 21 engages with the periphery of the swash plate 18 through a pair of shoes 23. The rotation of the swash plate 18 due to the rotation of the drive shaft 16 is converted to th reciprocation of the pistons 21.

The drive shaft 16 is operatively coupled to an engine or an external drive source 25 for traveling a vehicle through a power transmission mechanism 24. The power transmission mechanism 24 may be a clutch mechanism (for example, an electromagnetic clutch), which selectively transmits and disrupts power by an externally electrical control, or may be a clutchless mechanism (for example, a combination of a belt and a pulley), which continuously transmits power without the clutch mechanism. Incidentally, the clutchless type power transmission mechanism 24 is employed in the preferred embodiment.

The suction chamber 5 and the discharge chamber 7 are respectively defined in a space surrounded by the valve port assembly 13 and the rear housing 14. The refrigerant gas in the suction chamber 5 is introduced into the compression chambers 22 through respective suction ports 26 and respective suction valves 27 as each of the pistons 21 moves from a top dead center to a bottom dead center. The suction ports 26 and the suction valves 27 are formed in the valve port assembly 13. The refrigerant gas introduced in the compression chambers 22 is compressed ton a predetermined pressure value as each of the pistons 21 moves from the bottom dead center to the top dead center. The compressed refrigerant gas is discharged to the discharge chamber 7 through respective discharge ports 28 and respective discharge valves 29. The discharge ports 28 and the discharge valves 29 are formed in the valve port assembly 13.

An inclination angle of the swash plate 18 is optionally adjusted by varying relationship between pressures in the compression chambers 22 and pressure in the crank chamber 15 (crank pressure Pc), which is applied to the front end of the pistons 21. In the preferred embodiment, the inclination angle of the swash plate 18 is adjusted by actively varying the crank pressure Pc.

The housing of the compressor CP includes a blood passage 30, a supply passage 31 and a control valve 32. The bleed passage 30 interconnects the crank chamber 15 and the suction chamber 5 (a suction pressure region). The supply passage 31 interconnects the discharge chamber 7 (a discharge pressure region) and the crank chamber 15. The control valve 32 is arranged in the supply passage 31.

A balance between an amount of compressed refrigerant gas into the crank chamber 15 through the supply passage 31 and an amount of refrigerant gas out of the crank chamber 15 through the bleed passage 30 is controlled to determine the crank pressure Pc. A variation of the inclination angle of the swash plate 18 due to a variation of the crank pressure Pc adjusts the stroke of the pistons 21, that is, the displacement of the compressor CP.

For example, as th crank pressure Pc decreases by reducing an opening degree of the control valve 32, the inclination angle of the swash plate 18 increases so that the displacement of the compressor CP increases. On the contrary, as the crank pressure Pc increases by increasing the opening degree of the control valve 32, the inclination angle of the swash plate 18 decreases so that the displacement of the compressor CP decreases. The swash plate 18 illustrated by a solid line in FIG. 1 is in a state of the minimum displacement of the compressor CP. In the minimum state, the crank pressure Pc is substantially equal to the pressure in the discharge chamber 7 (a first discharge pressure PdH). The swash plate 18 illustrated by a two-dotted line in FIG. 1 is in a state of the maximum displacement of the compressor CP. In the maximum state, the crank pressure Pc is substantially equal to the pressure in the suction chamber 5 (a suction pressure Ps).

The control valve 32 will now be described with reference to FIG. 2. The upper side and the lower side of FIG. 2 respectively correspond to the upper side and the lower side of the control valve 32.

The control valve 32 includes a valve unit portion 51 and a solenoid portion 52. The valve unit portion 51 is the upper half portion of the control valve 32, while the solenoid portion 52 is the lower half portion of the control valve 32. The valve unit portion 51 adjusts the opening degree of the supply passage 31. The solon id portion 52 is a kind of electromagnetic actuators for controllably urging a cylindrical rod 53 based upon a control due to electric power externally supplied. The rod 53 is arranged in the control valve 32 so as to slide in a vertical direction of the control valve 32.

The valve unit portion 51 defines a valve hole 61 and a valve chamber 60. The valve hole 61 and the valve chamber 60 partially constitute the supply passage 31. The valve hole 61 communicates with the discharge chamber 7 through an upstream portion of the supply passage 31. The valve chamber 60 communicates with the crank chamber 15 through a downstream portion of the supply passage 31.

The rod 53 is inserted through the valve chamber 60 and the valve hole 61. A valve body portion 63, which is formed in the rod 53, is arranged in the valve chamber 60. The valve body portion 63 optionally adjusts the opening degree of the valve hole 61 based on the position of the valve body portion 63 in the valve chamber 60. For example, in a state when the rod 53 is located at the lowest position (the state shown in FIG. 2), the valve body portion 63 fully opens the valve hole 61. On the contrary, in a state when the rod 53 is located at the highest position, the valve body portion 63 fully closes the valve hole 61.

In the valve chamber 60, th crank pressure Pc is applied to a certain area of the end surface of the valve body portion 63 downward. The certain area is obtained by subtracting an area of aperture (a passing sectional area) S2 of the valve hole 61 from a cross-sectional area S3 of the rod 53.

A pressure sensing chamber 66 is defined above the valve hole 61 in the valve unit portion 51. The pressure sensing chamber 55 accommodates a pressure sensing member 54, which is constituted of a bellows. The upper end of the rod 53 is fitted to the lower end of the pressure sensing member 54, in the preferred embodiment, a pressure sensing means includes the rod 53 and the pressure sensing member 54. The pressure sensing chamber 55 is partitioned by the pressure sensing member 54 Into a high pressure chamber 56 and a low pressure chamber 57. The high pressure chamber 56 is defined inside the pressure sensing member 54, and the low pressure chamber 57 is defined outside the pressure sensing member 54.

Pressure in the discharge chamber 7 (first discharge pressure PdH) is applied to the high pressure chamber 56 through a first pressure introducing passage 58. Pressure in a portion of the second conduit 8, which is located closer to the gas cooler 2 than the fixed throttle 8*a*, (second discharge pressure PdL) is applied to the low pressure chamber 57. Accordingly, pressure difference between the first discharge pressure PdH in the high pressure chamber 56 and the second discharge pressure PdL in the low pressure chamber 57 (first pressure difference ΔP1=PdH−PdL) is applied to urge the rod 53 (the valve body portion 63) downward through the pressure sensing member 54. Incidentally, spring force (extension force) f1 of the pressure sensing member 54 is also applied to urge the rod 53 downward.

The solenoid portion 52 includes a plunger housing 71, which has a cylindrical shape, with a bottom at lower end. A solenoid chamber 73 is defined in the plunger housing 71 by a fixed iron core 72, which is fitted into the upper portion of the plunger housing 71. The lower half portion of the rod 53 is inserted into a guide hole 74 that extends through the fixed iron core 72. The lower end of the rod 53 protrudes into the solenoid chamber 73. A movable iron core 75 is fixedly fitted to the protruded portion of the rod 53. Accordingly, the movable iron core 75 and the rod 63 integrally move up and down. A coil spring 76 is accommodated in the solenoid chamber 73. Spring force f2 of the coil spring 76 is applied to the movable iron core 75 away from the fixed iron core 72 and urges the rod 53 downward.

Since a slight clearance (not shown) is held between the guide hole 74 and the rod 53, the valve chamber 60 communicates with the solenoid chamber 73 through the slight clearance. Accordingly, urging force based upon the crank pressure Pc in the solenoid chamber 73 is applied to the movable iron core 75 with a cross-sectional area S3 of the rod 53 upward.

A coil 77 is wound around the fixed iron core 72 and the movable iron core 75, and extends from the fixed iron core 72 to the movable iron core 75. The coil 77 is supplied with electric power from a drive circuit 82 based upon a command of an electrical control unit (ECU) 81. The coil 77 generates electromagnetic attraction (electromagnetic urging force F), which corresponds to the supplied electric power between the fixed iron core 72 and the movable iron core 75. The electromagnetic urging force F urges the rod 53 (the valve body portion 63) upward.

A control for supplying the coil 77 with electric power may be an analog electric current control or may be a duty control, which optionally varies a duty ratio Dt when electric current is supplied with the coil 77. The duty control is employed in the preferred embodiment. The drive circuit 82 supplies the electric power of a predetermined duty ratio Dt based upon the command of the ECU 81 with the coil 77. For example, as the duty ratio Dt increases, the upward urging force applied to the valve body portion 63 by the solenoid portion 52 is strengthened so that the opening degree of the valve body portion 63 tends to reduce. On the contrary as the duty ratio Dt reduces, the electromagnetic urging force F is weakened so that the opening degree of the valve body portion 63 tends to increase. In summary, the duty ratio Dt for driving the solenoid portion 52 positively correlates with the displacement of the compressor CP.

Accordingly, the control valve 32 positions the rod 53 (the valve body portion 63) at a position that satisfies the following expression I.

$$(PdH-PdL)(S1-S2)+(PdH-Pc)S2+f1+f2=F$$

S1 denotes an efficient pressure sensing area of the pressure sensing member 54 in the pressure sensing chamber 55. The spring forces f1, f2, the efficient pressure sensing area S1 and the area of aperture S2 are definitely determined as parameters at a stage of mechanical engineering. The electromagnetic urging force F is a variable parameter, which varies with the magnitude of electric power supplied to the coil 77. Accordingly, the coil 77 serves as a varying means.

As clearly indicated by the expression I, in the control valve 32, the pressure sensing means (the rod 53, the pressure sensing member 54) positions the rod 53 (the valve body portion 63) due to resultant force based upon the first pressure difference ΔP1 (=PdH−PdL) and the second pressure difference Δ P2 (=PdH−Pc). In other words, The pressure sensing means (the rod 53, the pressure sensing member 54) detects plural kinds of pressure (Pc, PdH, PdL) in the refrigerant circuit. The valve body portion 63 moves not only due to the variation of the first pressure difference ΔP1 but also due to the variation of the second pressure difference ΔP2.

Namely, in the control valve 32, the electromagnetic urging force F from the solenoid portion 52 determines relationship between the first pressure difference ΔP1 and the second pressure difference ΔP2, and the pressure sensing means (the rod 53, the pressure sensing member 54) positions the valve body portion 63 so as to maintain the relationship between the first pressure difference ΔP1 and the second pressure difference ΔP2. In other words, the valve body portion 63 is positioned by the pressure sensing means in such a manner that the displacement of the compressor CP is varied to cancel the variations of the first and second pressure differences ΔP1. ΔP2 in accordance with the variations of the pressures (PdH, Pdl) in the refrigerant circuit and the variation of the crank pressure Pc.

For example, as the flow rate of refrigerant in the refrigerant circuit increases due to an increase in rotational speed Nc of the drive shaft 16, pressure loss at the fixed throttle 8*a* increases so that the first pressure difference ΔP1 between both sides (the upstream and downstream sides) of the fixed throttle 8*a* increases. Furthermore, the first discharge pressure PdH increases due to flow resistance at the fixed throttle 8*a*. Additionally, as the flow rate of refrigerant increases, pressure in the evaporator 4 decreases so that the suction pressure Ps tends to decrease. Namely, an increase in the first discharge pressure PdH and a decrease in the suction pressure Ps increase th second pressure difference ΔP2. At the moment, the left side of the expression 1 becomes larger than the right side or the expression 1 so as to lose a balance between the left side and the right side of the expression 1.

When the left side of the expression 1 is larger than the right side of the expression 1 to lose the balance between the left side and the right side of the expression 1, the control valve 32 autonomously increases the opening degree of the valve so as to keep the balance between the left side and the right side of the expression 1 and functions to raise the crank pressure Pc. An increase in the crank pressure Pc decreases the displacement of the compressor CP. As the flow rate of refrigerant decreases due to a decrease in the displacement of the compressor CP, the first discharge pressure PdH decreases. That is, the control valve 32 autonomously prevents excessive first discharge pressure PdH.

Additionally, the control valve 32 varies the electromagnetic urging force F applied to the valve body portion 63 by the solenoid portion 52 based upon a command from the ECU 81 so as to vary a reference value for positioning the valve body portion 63 by the pressure sensing means (the rod 53, the pressure sensing member 54).

Incidentally, since the crank chamber 15 does not constitute a main refrigerant passage in th refrigerant circuit, th crank pressure Pc is strictly not regarded as pressure in the refrigerant circuit. However, as described above, the crank pressure Pc substantially equals the suction pressure Ps when the displacement of the compressor CP is maximum. Accordingly, in a state when the displacement of the compressor CP is maximum, the pressure sensing means (the rod 53, the pressure sensing member 54) is detecting the suction pressure Ps in the refrigerant circuit.

A control system of the control valve 32 will now be described.

Figure 2:
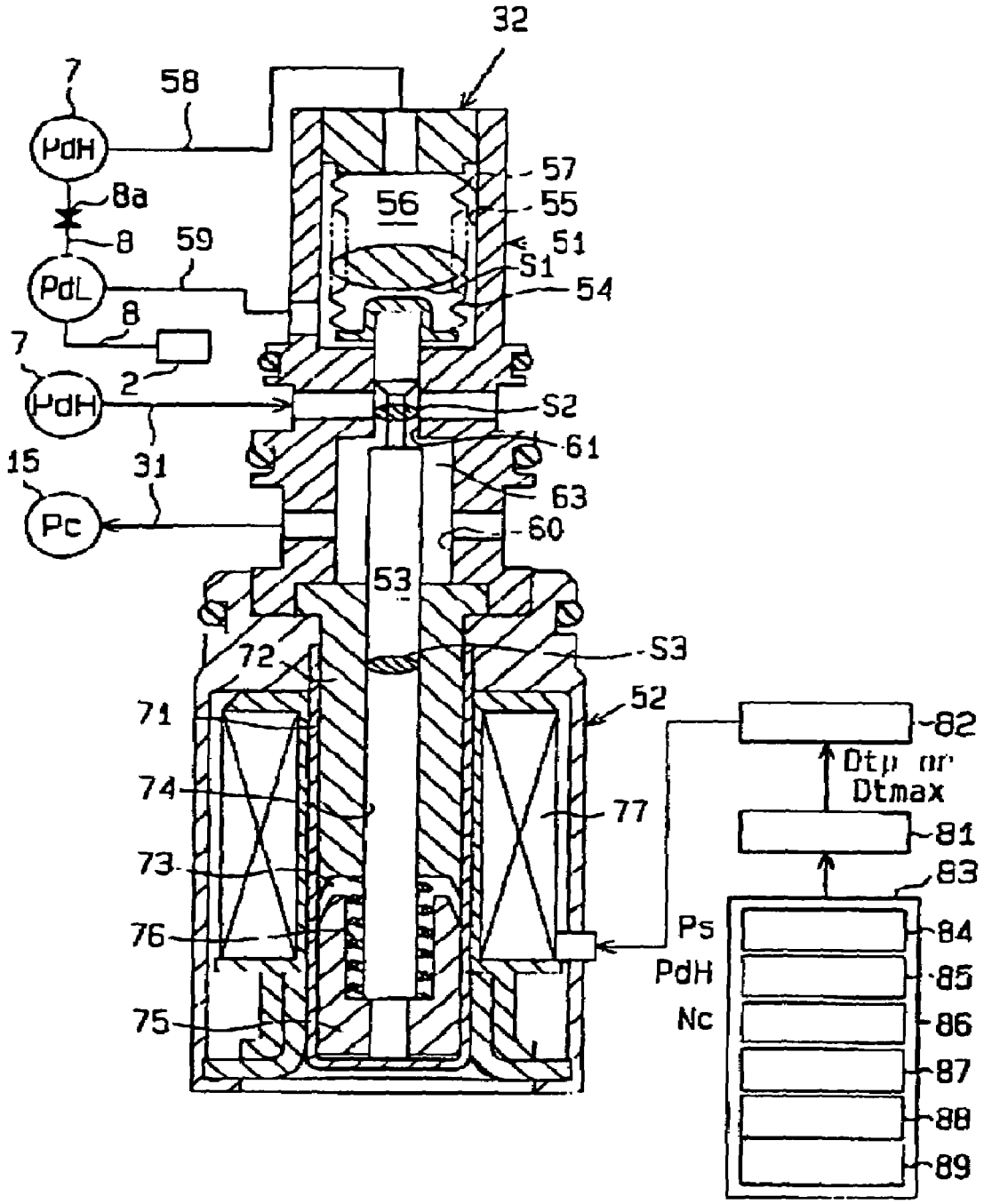
FIG. 2 is a longitudinal cross-sectional view of a control valve according to the preferred embodiment of the present invention.

As shown in FIG. 2, the ECU 81 is an electronic control unit and constitutes a calculator for calculating and a controller. The ECU 81 is similar to a computer that is provided with a control processing unit (CPU), a read only memory (ROM), a random access memory (RAM) and an input-output interface (I/O interface). An input terminal of I/O is connected to an external information detector 83, and an output terminal of I/O is connected to the drive circuit 82 of the control valve 32. The ECU 81 calculates an appropriate duty ratio Dt based upon various external information sent from the external information detector 83 and sends a command to the drive circuit 82 to actuate the solenoid portion 52 by the calculated duty ratio Dt.

The external information detector 83 includes a suction pressure sensor 84, a discharge pressure sensor 85 and a rotational speed sensor 86. The pressure sensing means (the rod 53, the pressure sensing member 54) of the control valve 32 mechanically detects the suction pressure Ps when the displacement of the compressor CP is maximum. Then, the suction pressure sensor 84 electrically detects the suction pressure Ps that is mechanically detected by the control valve 32. The discharge pressure sensor 85 electrically detects the first discharge pressure PdH that is mechanically detected by the pressure sensing means (the rod 53, the pressure sensing member 54). The rotational speed Nc of the drive shaft 16 correlates with the first pressure difference ΔP1 that is mechanically detected by the pressure sensing means (the rod 53, the pressure sensing member 54). The rotational speed sensor 86 electrically detects the rotational speed Nc of the drive shaft 16. In summary, the suction pressure sensor 84, the discharge pressure sensor 85 and the rotational speed sensor 80 serve as a pressure detector.

The external information detector 83 includes a temperature setting device 87, a temperature sensor 88 and an air conditioner switch 89. A passenger of a vehicle sets a temperature in a passenger compartment by the temperature setting device 87. Temperature in the passenger compartment is detected by the temperature sensor 88.

The ECU 81 calculates a duty ratio Dtp bas d upon information from the temperature setting device 87 and the temperature sensor 88. In other words, the ECU 81 compares a detected temperature detected by the temperature sensor 88 with a set temperature set by the temperature setting device 87. The ECU 81 increases or decreases the duty ratio Dtp to cancel difference between the detected temperature and the set temperature. For example, when the detected temperature is higher than the set temperature, the duty ratio Dtp is increased. Accordingly, the electromagnetic urging force F of the solenoid portion 52 increases to decrease the opening degree of the valve body portion 63 so that the displacement of the compressor CP is increased. On the contrary, when the detected temperature is lower than the set temperature, the duty ratio Dtp is decreased. Accordingly, the electromagnetic urging force F of the solenoid portion 52 is decreased to increase the opening degree of the valve body portion 63, so that the displacement of the compressor CP is decreased.

The ECU 81 calculates a maximum value (a maximum duty ratio Dtmax) or a limit value, which is a variation range limit of the duty ratio Dt to increase the displacement of the compressor CP, from a preset function f(Ps, PdH, Nc) based upon information (Ps, PdH, Nc) detected by the suction pressure sensor 84, the discharge pressure sensor 85 and the rotational speed sensor 86. When the solenoid portion 52 is actuated at the maximum duty ratio Dtmax, the displacement of the compressor CP is maximized by the pressure sensing means (the rod 53, th pressure sensing member 54) of the control valve 32 in a state when the pressures (Ps, PdH) and the rotational speed Nc are utilized for calculating the maximum duty ratio Dtmax.

The ECU 81 calculates the maximum duty ratio Dtmax in view of reliably performing the maximum displacement of the compressor CP and reducing the duty ratio Dt for actuating the solenoid portion 52. Accordingly, the function f(Ps, PdH, Nc) is set to calculate the maximum duty ratio Dtmax, which is greater than a minimum duty ratio Dt for maximizing the displacement of the compressor CP, in view of detection error of each sensor 84, 85, 86, the movement of the rod 53 due to vibration of a vehicle and the like. The ECU 81 sets the maximum duty ratio Dtmax as a maximum value and increases or decreases the duty ratio Dt for actuating the solenoid portion 52 so as not to exceed the maximum duty ratio Dtmax.

Namely, the ECU 81 obtains all of the pressures (Ps (Pc), PdH, PdL) detected by the pressure sensing means (the rod 53, the pressure sensing member 54) of the control valve 32. Incidentally, the crank pressure Pc substantially equals the suction pressure Pc when the displacement of the compressor CP is maximum. Therefore, in this state, plural kinds of pressure detected by the pressure sensing means (the rod 53, the pressure sensing member 54) of the control valve 32 are the suction pressure Ps, the first discharge pressure PdH and the second discharge pressure PdL.

Obtaining the above pressures, the ECU 81 optionally obtains a boundary between a range of the electromagnetic urging force F of the solenoid portion 52 for maximizing the displacement at the compressor CP and a range of the electromagnetic urging force F for not maximizing the displacement of the compressor CP. The boundary is minimum electromagnetic urging force F for maximizing the displacement of the compressor CP. Based upon the obtained boundary, the ECU 81 optionally calculates a maximum value of the electromagnetic urging force F close to the boundary, that is, the maximum duty ratio Dtmax, and controls the duty ratio Dt in such a manner that the electromagnetic urging force F of the solenoid portion 52 does not largely exceed the boundary toward a side at the maximum displacement.

Figure 3:
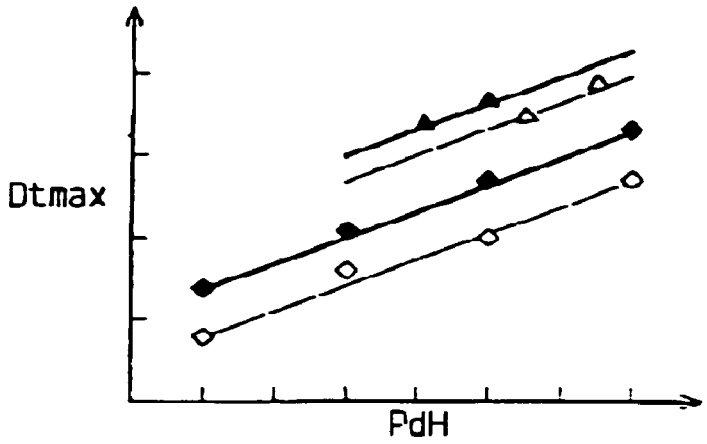
FIG. 3 is a graph showing relationship between a first discharge pressure and a maximum duty ratio according to the preferred embodiment of the present invention.

The function f(Ps, PdH, Nc) is an approximate expression that is determined with experimental value based upon an expression where "Ps" is substituted for "Pc" of the expression 1 to meet the requirement of the maximum displacement of the compressor CP. FIG. 3 is an experimental result showing relationship between the first discharge pressure PdH and the maximum duty ratio Dtmax according to the preferred embodiment of the present invention Each plot "◇", "◆", "Δ", "▲" is an observed value in the graph and each shows different combinations of the suction pressure Ps and the, rotational speed Nc. Identically, in the same plot, the suction pressure Ps and the rotational speed Nc are fixed.

Magnitude relation of the suction pressure Ps among the plots "◇", "◆", "Δ", "▼" is "▼"="◆"<"Δ"<"◇". Magnitude relation of the rotational speed Nc among the plots "◇", "◆", "Δ", "◆" is "◇"="▲"<"Δ"="▲".

According to FIG. 3, the following relationships are read. The higher first discharge pressure PdH requires the maximum duty ratio Dtmax to be set higher. The lower suction pressure Ps requires the maximum duty ratio Dtmax to be set higher. The higher rotational speed Nc requires the maximum duty ratio Dtmax to be set higher. In the same group of plots, a line passing on each of the plots and/or near the plots is defined as an approximate expression of each group of plots. The function f(Ps, PdH, Nc) is determined based upon the approximate expression of each group of plots and difference of set conditions of the suction pressure Ps and/or the rotational speed Nc among each group of plots.

Figure 4A:
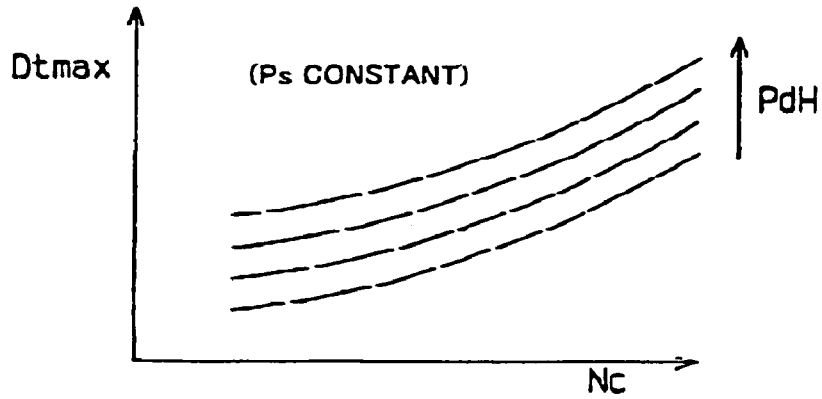
FIG. 4A is a graph showing relationship between rotational speed and maximum duty ratio according to the preferred embodiment of the present invention.
Figure 4B:
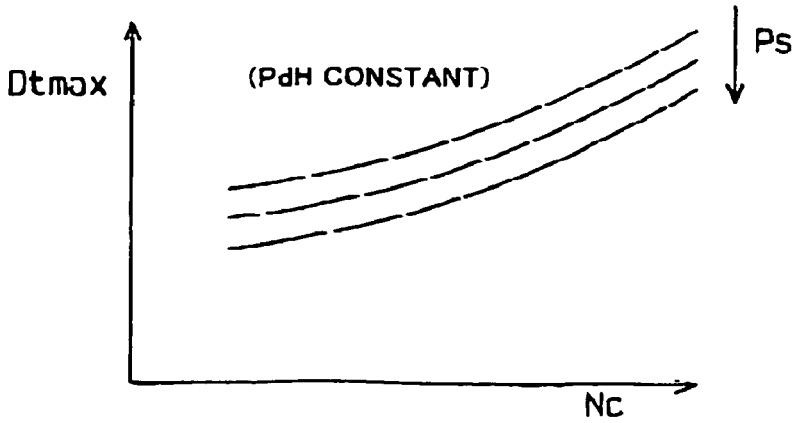
FIG. 4B is a graph showing relationship between rotational speed and maximum duty ratio according to the preferred embodiment of the present invention.

The function f(Ps, PdH, Nc) determined in the above manner has a relational characteristic (a relational characteristic between the rotational speed Nc and the maximum duty ratio Dtmax) such as characteristic curve shown in FIGS. 4A and 4B.

Each characteristic curve exemplified in FIG. 4A is in a state when each suction pressure Ps equals to one another and each first discharge pressure PdH differs from one another. The upper characteristic curve has a greater first discharge pressure PdH than the lower characteristic curve. Pressure difference (difference of the first discharge pressure PdH) between each coadjacent characteristic curves equals one another. In other words, if each suction pressure Ps equals one another, the higher first discharge pressure PdH causes the higher maximum duty ratio Dtmax relative to the same rotational speed Nc. In the coadjacent characteristic curves, difference between each maximum duty ratio Dtmax relative to the rotational speed Nc, that is, a vertical interval between the coadjacent characteristic curves in FIG. 4A is substantially constant despite high and low of the first discharge pressure PdH.

Each characteristic curve exemplified in FIG. 4B is in a state when each first discharge pressure PdH equals one another and each suction pressure Ps differs from one another. The lower characteristic curve has a greater suction pressure Ps than the upper characteristic curve. Pressure difference (difference of the suction pressure Ps) between each coadjacent characteristic curves equals one another. In other words, if each first discharge pressure PdH equals one another, the lower suction pressure Ps causes the higher maximum duty ratio Dtmax relative to the same rotational speed Nc. In the coadjacent characteristic curves, difference between each maximum duty ratio DTmax relative to the rotational speed Nc, that is, a vertical Interval between the coadjacent characteristic curves in FIG. 4B is substantially constant despite high and low of the suction pressure Ps.

Each characteristic curve in FIGS. 4A and 4B illustrates that the higher rotational speed Nc has a greatest maximum duly ratio Dtmax. The higher rotational speed Nc has a greater increasing tendency of the maximum duty ratio Dtmax. In the function f(Ps, PdH, Nc) for determining the maximum duty ratio Dtmax, this indicates that the variation of the rotational speed Nc much influences than that of other input parameters within the input parameters (the suction pressure Ps, the discharge pressure PdH and the rotational speed Nc).

A control of the air conditioner by the ECU 81 will now be described.

Figure 5:
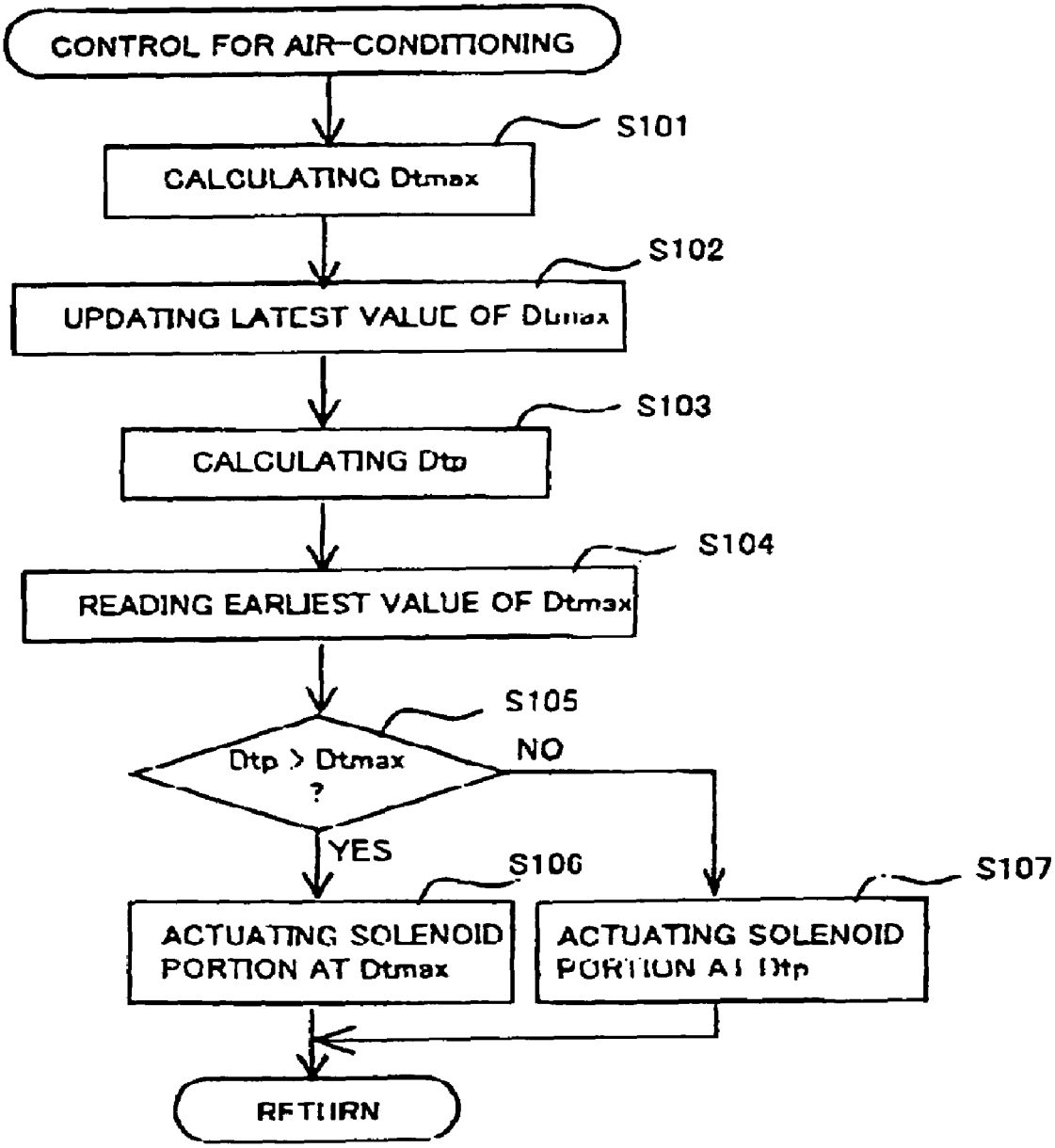
FIG. 5 is a flow chart showing a process for controlling an air conditioner according to the preferred embodiment of the present invention.

FIG. 5 is a flow chart illustrating a process for controlling the air conditioner. As the air conditioner switch 89 is turned on, the ECU 81 initiates to process a previously stored program. The ECU 81 repeatedly exerts processing a control of the air conditioner as far as the air conditioner switch 89 is in an ON-state.

At a step (hereinafter, S) 101, the ECU 81 calculates a maximum duty ratio Dtmax by the previously stored function f(Ps, PdH, Nc) based upon information (Ps, PdH, Nc) detected by the suction pressure sensor 84, the discharge pressure sensor 85 and the rotational speed sensor 86, respectively.

At S102, the ECU 81 stores the currently calculated maximum duty ratio Dtmax as a latest value in a storage region of the RAM. The storage region of the RAM for the maximum duty ratio Dtmax optionally stores a plurality of maximum duty ratios Dtmax (predetermined number of stored maximum duty ratios Dtmax) by allocating the maximum duty ratios Dtmax in order in which the maximum duty ratios Dtmax are calculated. Every time a current maximum duty ratio Dtmax is calculated, an earliest value is deleted and a second earliest value calculated subsequently after the above earliest value is determined as a new earliest value. Incidentally, as the air conditioner switch 89 is turned off, the storage region for the maximum duty ratio Dtmax is cleared. Additionally, since the storage region of the RAM for the maximum duty ratio Dtmax is blank when the air conditioner switch 89 is turned on, an initially calculated maximum duty ratio Dtmax is stored as an earliest value through a latest value only when the initial maximum duty ratio Dtmax is calculated.

At S103, the ECU 81 calculates a duty ratio Dtp based upon set temperature information from the temperature setting device 87 and detected temperature information from the temperature sensor 88. At S104, the ECU 81 reads the earliest value of the maximum duty ratio Dtmax from the stored region of the RAM for the maximum duty ratio Dtmax, that is, the maximum duty ratio Dtmax calculated based upon the information (Ps, PdH, Nc) that are detected predetermined time before. At S105, the ECU 81 judges whether or not the calculated duty ratio Dtp is greater than the read maximum duty ratio Dtmax.

When the judgment of the S105 is YES, that is, when the calculated duty ratio Dtp is greater than the read maximum duty ratio Dtmax, the ECU 81 sends a command to the drive circuit 82 to actuate the solenoid portion 52 with the road maximum duty ratio Dtmax at S106. On the contrary, when the judgment of the S105 is NO, that is, when the calculated duty ratio Dtp is equal to or smaller than the read maximum duty ratio Dtmax, the ECU 81 sends a command to the drive circuit 82 to actuate the solenoid portion 52 with the calculated duty ratio Dtp at S107.

According to the preferred embodiment, the following advantageous effects are obtained.

(1) The ECU 81 obtains all kinds of pressure detected by the pressure sensing means (the rod 53, the pressure sensing member 54) in the refrigerant circuit, so that the ECU 81 optionally obtains a boundary between a region of the electromagnetic urging force F for maximizing the displacement of the compressor CP and a region of the electromagnetic urging force F for not maximizing the displacement of the compressor CP. Based upon the obtained boundary, the ECU 81 optionally calculates a maximum value of the electromagnetic urging force F close to the boundary (the maximum duty ratio Dtmax) and controls the electromagnetic urging force F of the solenoid portion 52 so as not to largely exceed the boundary toward a side of the maximum displacement.

For example, the duty ratio Dt for actuating the solenoid portion 52 is determined to be the maximum duty ratio Dtmax due to cooling down and the like. Accordingly, the electromagnetic urging force F applied to the valve body portion 63 by the solenoid portion 52 is maximum within a limited range, and the displacement of the compressor CP is maximum. In this state, as the rotational speed Nc of the compressor CP (the drive shaft 16) rapidly increases due to rapid acceleration of a vehicle and the like, the pressures (Ps, PdH, PdL) in the refrigerant circuit vary so that relationship between the first pressure difference ΔP1 and the second pressure difference ΔP2, which are detected by the pressure sensing means (the rod 53, the pressure sensing member 54), is varied. Even if the relationship between the first pressure difference ΔP1 and the second pressure difference ΔP2 only slightly varies, the electromagnetic urging force F (the maximum duty ratio Dtmax) of the solenoid portion 52 before the variation of the relationship is involved in a range where the displacement of the compressor CP cannot be maximized under relationship between a new first pressure difference ΔP1 and a new second pressure difference ΔP2. Therefore, the pressure sensing means (the rod 53, the pressure sensing member 54) quickly moves the valve body portion 53 toward a side for decreasing the displacement of the compressor CP. Accordingly, the compressor CP quickly leaves a state of the maximum displacement so that an excessive increase in the first discharge pressure PdH due to delay of the leaving of the maximum displacement state is prevented.

(2) The ECU 81 regards the maximum duty ratio Dtmax, which is calculated based upon the information (Ps, PdH, Nc) detected predetermined time before, as an upper limit and controls the duty ratio Dt of the solenoid portion 52. For example, when the rotational speed Nc of the drive shaft 16 has a tendency to increase, the maximum duty ratio Dtmax calculated by the ECU 81 becomes smaller than a maximum duty ratio Dtmax corresponding to the pressure (Ps, PdH, PdL) detected by the pressure sensing means (the rod 53, the pressure sensing member 54) at the moment. Accordingly, when the rotational speed Nc of the drive shaft 16 rapidly increases, the movement of the valve body portion 63 is relatively early initiated toward a side for decreasing the displacement of the compressor CP by the pressure sensing means (the rod 53, the pressure sensing member 54) so that an excessive increase in the first discharge pressure PdH is effectively prevented.

Figure 6A:
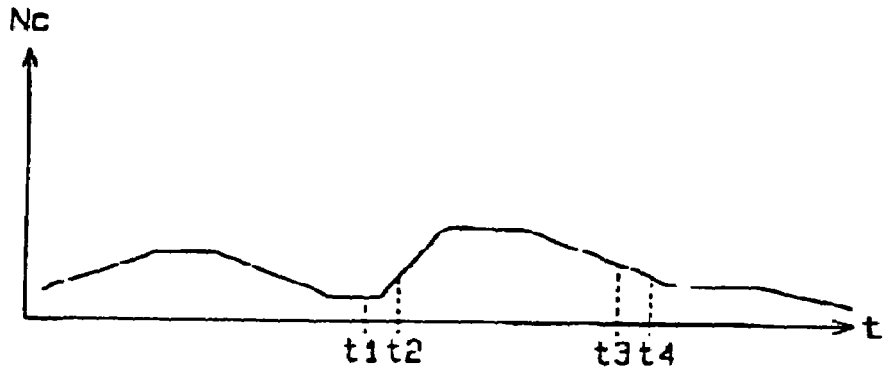
FIG. 6A is a graph showing temporal transition of rotational speed according to the preferred embodiment of the present invention.
Figure 6B:
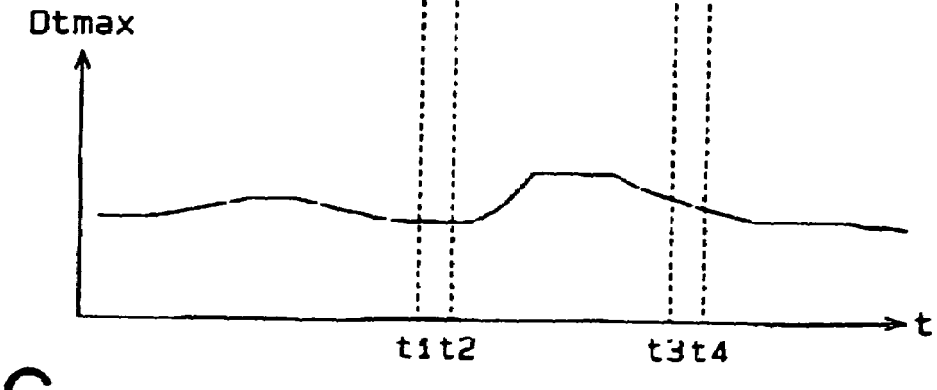
FIG. 6B is a graph showing temporal transition of maximum duty ratio according to the preferred embodiment of the present invention.
Figure 6C:
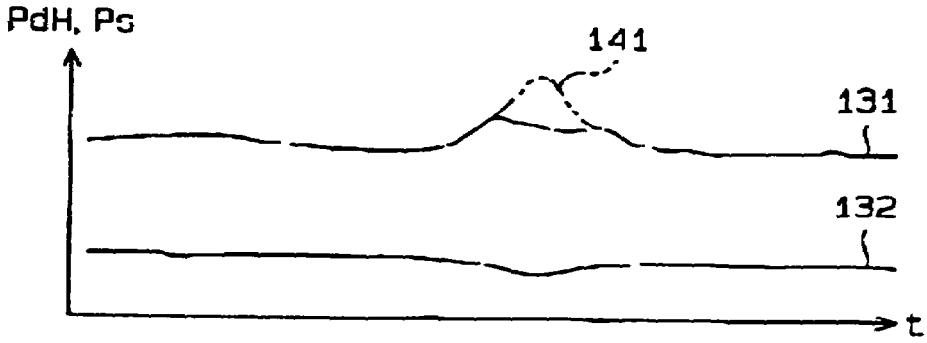
FIG. 6C is a graph showing temporal transition of first discharge pressure and suction pressure according to the preferred embodiment of the present invention.

Namely, for example, FIGS. 6A, 6B and 6C are graphs showing temporal transition of the rotational speed Nc, the maximum duty ratio Dtmax, the first discharge pressure PdH and the suction pressure Ps. Incidentally, a characteristic curve 131 shown in FIG. 6C shows a temporal transition of the first discharge pressure PdH. A characteristic curve 132 shows a temporal transition of the suction pressure Ps.

In the preferred embodiment, a maximum duty ratio Dtmax utilized for controlling the air conditioner at t2 is calculated based upon the suction pressure Ps, the first discharge pressure PdH and the rotational speed Nc at t1, which is predetermined time (t2−t1) before t2.

In other words, the maximum duty ratio Dtmax, which corresponds to the pressure (Ps, PdH, PdL) detected by the pressure sensing means (the rod 53, the pressure sensing member 54) at t1 in the refrigerant circuit, is determined as an upper limit value at t2. When the rotational speed Nc has a tendency to increase, the maximum duty ratio Dtmax determined as the upper limit value is smaller than a maximum duty ratio Dtmax that corresponds to the pressure (Ps, PdH, PdL) detected by the pressure sensing means (the rod 53, the pressure sensing member 54) at t2 in the refrigerant circuit. Accordingly, when the rotational speed Nc of the drive shaft 16 increases, the solenoid portion 52 is actuated in such a manner that a relatively small maximum duty ratio Dtmax is determined as an upper limit value, so that the movement of the valve body portion 63 toward a direction to open the valve, that is, a decrease in the displacement of the compressor CP is relatively early initiated after commencement of rapid acceleration of a vehicle.

Incidentally, a maximum duty ratio Dtmax utilized for controlling the air conditioner at t4 is also calculated based upon the suction pressure Ps, the first discharge pressure PdH and the rotational speed Nc at t3, which is predetermined time (t4−t3) (=(t2−t1)) before t4. When the rotational speed Nc of the drive shaft 16 has a tendency to decrease, the maximum duty ratio Dtmax utilized for controlling the air conditioner at t4 is greater than a maximum duty ratio Dtmax that corresponds to the pressure (Ps, PdH, PdL) detected by the pressure sensing means (the rod 53, the pressure sensing member 54) at t4 in the refrigerant circuit. However, when the rotational speed Nc has a tendency to decrease, the flow rate of refrigerant in the refrigerant circuit shows a tendency to decrease in accordance with a decrease in the rotational speed Nc. Accordingly, for example, even if a duty ratio Dt (a maximum duty ratio Dtmax) for actuating the solenoid portion 52 is excessive at t4 so that the movement of the fully-closed valve body portion 63 toward a direction to open the valve delays due to a decrease in the rotational speed Nc, an excessive increase in the first discharge pressure PdH due to the delay does not occur.

Incidentally, a characteristic curve 141 shown in FIG. 6C illustrates a temporal transition of a first discharge pressure PdH in a prior art, for which the ECU 81 does not control a duty ratio Dt of the solenoid portion 52 by determining a maximum duty ratio Dtmax as an upper limit value. Th characteristic curve 141 indicates that the first discharge pressure PdH in the prior art excessively increases in comparison to the first discharge pressure PdH in the preferred embodiment.

(3) The control valve 32 is configured in such a manner that the duty ratio Dt for actuating the solenoid portion 52 positively correlates with the displacement of the compressor CP. Accordingly, the duty ratio Dt for actuating the solenoid portion 52 is controlled so as not to exceed the maximum duty ratio Dtmax so that the magnitude of electric power supplied to the solenoid portion 52 is restricted. Thus, power consumption of the solenoid portion 52 is reduced and load on a vehicle battery, which is a power source of the solenoid portion 52, is reduced. This leads to reducing in fuel consumption of a vehicle.

(4) The ECU 81 calculates the maximum duty ratio Dtmax based upon information of the rotational speed Nc. The rotational speed sensor 86 is employed for detecting the rotational speed Nc in the preferred embodiment. The information of the rotational speed Nc is utilized for calculating the maximum duty ratio Dtmax so that the rotational speed Nc of the drive shaft 16 may be obtained by utilizing the information of the rotational speed of the engine 25, for example. In this state, the rotational speed Nc is obtained without additionally providing the rotational speed sensor 86 for detecting the rotational speed Nc of the drive shaft 16.

(5) The pressure sensing means (the rod 53, (the pressure sensing member 54) of the control valve 32 moves the valve body portion 63 by detecting plural kinds of pressure (Ps, PdH, PdL). Tho external information detector 83 provider the ECU 61 with the detected information (Ps, PdH, Nc) related to all kinds of pressure (Ps, PdH, PdL), which are detected by the pressure sensing means. Accordingly, the ECU 81 improves accuracy for calculating the maximum duty ratio Dtmax so that the maximum duty ratio Dtmax is brought close to a boundary between a range of the electromagnetic urging force F of the solenoid portion 52 for maximizing the displacement of the compressor CP and a range of the electromagnetic urging force F for not maximizing the displacement of the compressor CP as much as possible.

When the rotational speed Nc of the drive shaft 16 rapidly increases, the movement of the valve body portion 63 toward a side for decreasing the displacement of the compressor CP is early initiated. As a result, an excessive increase in the first discharge pressure PdH is effectively prevented. Also, power consumption of the solenoid portion 52 is reduced.

(6) Carbon dioxide is employed as refrigerant in the refrigerant circuit of the vehicle air conditioner. When the carbon dioxide refrigerant is employed, heat is possibly exchanged in a stat when refrigerant is cooled in an excessive critical range, which exceeds critical temperature of the refrigerant. Accordingly, the first discharge pressure PdH is more than ten times greater than pressure when fluorocarbon refrigerant is employed so that load on the compressor CP, a conduit and the like due to an excessive increase in the first discharge pressure PdH becomes excessively large. Additionally, in the above described structure, the rotational speed Nc of the drive shaft 16 may directly influence on the first discharge pressure PdH in comparison to the structure employing fluorocarbon refrigerant. Accordingly, it is particularly effective to apply the present invention to the preferred embodiment and to prevent an excessive increase in the first discharge pressure PdH.

The present invention is not limited to the above embodiment but may be modified into the following alternative embodiments.

In the preferred embodiment, the ECU 81 controls the duty ratio Dt of the solenoid portion 52 by determining the maximum duty ratio Dtmax, which is calculated based upon information (Ps, PdH, Nc) detected predetermined time before, as an upper limit value. In alternative embodiments, a maximum duty ratio Dtmax utilized for processing a control of the air conditioner employs a latest value, which is calculated in a process for calculating the maximum duty ratio Dtmax. In this state. In the calculating process, a plurality of the maximum duty ratios Dtmax from the latest value to the earliest value need not be stored so that consumption of the storage region of the RAM is reduced.

In the preferred embodiment, the maximum duty ratio Dtmax is calculated by means of the function f(Ps, PdH, Nc). In alternative embodiments, a maximum duty ratio is calculated by referring map data including previously stored suction pressure Ps, first discharge pressure PdH and rotational speed Nc as parameters.

In the preferred embodiment, the function f(Ps, PdH, Nc) determines the first discharge pressure PdH as a variable. In alternative embodiments. In the function f(Ps, PdH, Nc), a function f(Ps, Nc) including a first discharge pressure PdH as a fixed value is utilized for calculating the maximum duty ratio Dtmax. In this state, the fixed value of the first discharge pressure PdH may be a first discharge pressure PdH that is not allowed to exceed in the refrigerant circuit. Thus, the external information detector 83 (the pressure sensing means) is simplified by omitting the discharge pressure sensor 85. Additionally, the function f(Ps, Nc) is simplified so that load on the ECU 81 for operation is reduced when the maximum duty ratio Dtmax is calculated.

In the preferred embodiment, the rotational speed Nc of the drive shaft 16 is detected by an exclusive sensor. In alternative embodiments, an ECU for controlling the engine 25 sends information f the rotational speed of the engine 25 for controlling the engine 25 to the ECU 81, and the ECU 81 understands the rotational speed Nc of the drive shaft 16 through the information of the rotational speed of the engine 25.

In alternative embodiments to the preferred embodiment, the rotational speed sensor 86 is omitted, while a pressure sensor is provided for detecting the second discharge pressure PdL, f(Ps, PdH, PdL) is determined as a function, and the maximum duty ratio Dtmax is calculated by the function f(Ps, PdH, PdL). Thus, the ECU 81 directly obtains pressures (Ps, PdH, PdL) related to positioning of the valve body portion 63 so that a rather small maximum duty ratio Dtmax may be calculated. Accordingly, power consumption of the solenoid portion 52 is further reduced.

In the preferred embodiment, the control valve 32 is configured in such a manner that the duty ratio Dt for actuating the solenoid portion 52 positively correlates with the displacement of the compressor CP. In alternative embodiments, a control valve is configured in such a manner that a duty ratio for actuating a solenoid portion negatively correlates with the displacement of the compressor CP. In this state, a calculator for calculating a limit value calculates a minimum duty ratio Dtmin as a limit value, which is a variation limit of the duty ratio Dt toward a side for increasing the displacement of the compressor CP.

In the preferred embodiment, the pressure sensing means (the rod 53, the pressure sensing member 54) is configures to detect the first pressure difference ΔP1 and the second pressure difference ΔP2, and to move the valve body portion 63 in such a manner that the displacement of the compressor CP is varied to cancel the variations of the first pressure difference ΔP1 and the second pressure difference ΔP2. In alternative embodiments, a pressure sensing means is configured to detect one of the first pressure difference ΔP1 and the second pressure difference ΔP2 to position a valve body.

In alternative embodiments to the preferred embodiment, the present invention is applied to a control system for a variable displacement compressor that employs a control valve in which a set suction pressure is variable.

In alternative embodiments to the preferred embodiment, a control system of the present invention is applied to a wobble type variable displacement compressor or a double headed piston type variable displacement compressor.

Therefore, the present examples and embodiments are to be considered as illustrative and not restrictive, and the invention is not to be limited to the details given herein but may be modified within the scope of the appended claims.

What is claimed is:

1. A control system for use in a variable displacement compressor of a refrigerant circuit in an air conditioner, the compressor compressing refrigerant by rotation of a drive shaft of the compressor, while displacement of the compressor is variable, the control system comprising:

a control valve including:

a valve body;

a pressure sensing means for mechanically detecting at least one pressure of plural kinds of pressure in the refrigerant circuit, the pressure sensing means moving the valve body in such a manner that the displacement of the compressor is varied to cancel variation of a detected pressure detected by the pressure sensing means; and a varying means for varying a reference value for positioning the valve body by the pressure sensing means;

a pressure detector for electrically detecting the pressure detected by the pressure sensing means in the refrigerant circuit and/or physical quantity which correlates with the pressure detected by the pressure sensing means in the refrigerant circuit;

a calculator for calculating a limit value based upon information detected by the pressure detector, wherein the limit value is a variation limit of urging force applied to the valve body by the varying means toward an increasing side of the displacement of the compressor; and a controller for controlling the varying means in such a manner that the urging force applied to the valve body does not exceed the limit value toward the increasing side of the displacement of the compressor, wherein the displacement of the compressor is maximized by the pressure sensing means under the pressure when the varying means applies urging force of the limit value to the valve body.

2. The control system according to claim 1, wherein the controller controls the varying means in such a manner that the controller determines a limit value calculated by the calculator based upon information detected by the pressure detector predetermined time before as a variation limit of the urging force applied to the valve body.

3. The control system according to claim 1, wherein the varying means includes an electromagnetic actuator, the electromagnetic actuator optionally varying electromagnetic urging force applied to the valve body in response to supplied electric power which is externally controlled by the controller, the control valve being configured to vary an opening degree of the valve body toward the increasing side of the displacement of the compressor as the electromagnetic urging force of the electromagnetic actuator increases.

4. The control system according to claim 1, wherein the pressure sensing means optionally detects pressure difference between two pressure monitoring points located in the refrigerant circuit, the pressure sensing means moving the valve body based upon the variation of the pressure difference between the two pressure monitoring points in such a manner that the displacement of the compressor is varied to cancel variation of the pressure difference, rotational speed of a drive shaft of the compressor correlating with the pressure difference between the two pressure monitoring points, the pressure detector detecting the rotational speed of the drive shaft, the calculator calculating the limit value based upon information of the rotational speed from the pressure detector.

5. The control system according to claim 1, wherein the pressure sensing means moving the valve body by detecting plural kinds of pressure, the pressure detector providing the calculator with detected information related to all kinds of pressure detected by the pressure sensing means.

6. The control system according to claim 1, wherein carbon dioxide is employed as refrigerant in the refrigerant circuit.

7. The control system according to claim 1, wherein the pressure detector includes:

a suction pressure sensor for detecting suction pressure of the compressor;

a discharge pressure sensor for detecting discharge pressure of the compressor; and a rotational speed sensor for detecting rotational speed of the drive shaft.

8. A method for controlling a control valve for use in a variable displacement compressor of a refrigerant circuit in an air conditioner of a vehicle, the compressor compressing refrigerant by rotation of a drive shaft of the compressor, while displacement of the compressor is optionally varied by the control valve, the control valve having a solenoid portion which is externally controlled by means of a duty control, the method comprising:

detecting at least one pressure of plural kinds of pressure in the refrigerant circuit and/or physical quantity which correlates with at least one pressure of plural kinds of pressure in the refrigerant circuit;

calculating a maximum duty ratio for the duty control based upon a value detected at the detecting step;

further detecting temperature in a passenger compartment of the vehicle;

obtaining set temperature for the passenger compartment;

further calculating a duty ratio for the duty control based upon the detected temperature and the obtained set temperature;

actuating the solenoid portion by the maximum duty ratio when the duty ratio is greater than the maximum duty ratio; and actuating the solenoid portion by the duty ratio when the duty ratio is equal to or smaller than the maximum duty ratio.

9. The method for controlling the control valve according to claim 8, further comprising:

storing the predetermined number of maximum duty ratios by allocating the maximum duty ratios in order in which the maximum duty ratios are calculated;

determining an initially calculated maximum duty ratio as an earliest value; and determining a currently calculated maximum duty ratio as a latest value in such a manner that the earliest value is deleted and the second earliest value is determined as a new earliest value.

10. The method for controlling the control valve according to claim 8, wherein the value detected at the detecting step includes suction pressure of the compressor, first discharge pressure of the compressor and rotational speed of the drive shaft.

11. The method for controlling the control valve according to claim 10, wherein the first discharge pressure of the compressor is determined as a fixed value.

12. The method for controlling the control valve according to claim 10, wherein the rotational speed of the drive shaft is obtained by rotational speed of an engine of the vehicle.

13. The method for controlling the control valve according to claim 8, wherein the value detected at the detecting stop includes suction pressure of the compressor, first discharge pressure of the compressor and second discharge pressure of the compressor.

14. The method for controlling the control valve according to claim 8, wherein the maximum duty ratio is calculated by means of a function including the value detected at the detecting step.

15. The method for controlling the control valve according to claim 8, wherein the maximum duty ratio is calculated by means of referring map data for the value detected at the detecting step.

* * * * *

UNITED STATES PATENT AND TRADEMARK OFFICE

CERTIFICATE OF CORRECTION

PATENT NO. : 7,243,502 B2
APPLICATION NO. : 10/741726
DATED : July 17, 2007
INVENTOR(S) : Satoshi Umemura et al.

It is certified that error appears in the above-identified patent and that said Letters Patent is hereby corrected as shown below:

In the Specification

Column 1, line 30, please delete "variation n of the pressure" and insert therefore -- variation of the pressure --;

Column 2, line 14, please delete "due to th rapid acceleration" and insert therefore -- due to the rapid acceleration --;

Column 2, line 15, please delete "flow rat" and insert therefore -- flow rate --;

Column 5, lines 15-16, please delete "converted to th reciprocation" and insert therefore -- converted to the reciprocation --;

Column 5, line 37, please delete "compressed ton" and insert therefore -- compressed to --;

Column 5, lines 51-52, please delete "blood passage 30" and insert therefore -- bleed passage 30 --;

Column 6, line 25, please delete "solon id portion 52" and insert therefore -- solenoid portion 52 --;

Column 6, line 55, please delete "pressure sensing chamber 66" and insert therefore -- pressure sensing chamber 55 --;

Column 6, line 63, please delete "sensing member 54 Into" and insert therefore -- sensing member 54 into --;

Column 7, line 16, please delete "with a bottom at lower end" and insert therefore -- with a bottom at a lower end --;

Column 7, line 24, please delete "the rod 63" and insert therefore -- the rod 53 --;

Column 7, line 65, please delete "expression I" and insert therefore -- expression 1 --;

Column 8, line 10, please delete "expression I" and insert therefore -- expression 1 --;

Column 8, lines 24-25, please delete "determines relationship" and insert therefore -- determines the relationship --;

Column 8, line 34, please delete "$\Delta$P1. $\Delta$P2" and insert therefore -- $\Delta$P1, $\Delta$P2 --;

Column 8, line 35, please delete "(PdH, Pd1)" and insert therefore -- (PdH, PdL) --;

Column 8, line 47, please delete "increase th second pressure difference ΔP2. At the" and insert therefore -- increase the second pressure difference ΔP2. At that --;

Column 8, line 49, please delete "right side or the expression 1" and insert therefore -- right side of the expression 1 --;

Column 9, lines 4-5, please delete "passage in th refrigerant circuit, th crank pressure Pc" and insert therefore -- passage in the refrigerant circuit, the crank pressure Pc --;

Column 9, line 46, please delete "rotational speed sensor 80" and insert therefore -- rotational speed sensor 86 --;

Column 9, line 53, please delete "ratio Dtp bas d upon" and insert therefore -- ratio Dtp based upon --;

Column 9, line 59, please delete "to cancel difference" and insert therefore -- to cancel the difference --;

Column 10, line 35, please delete "suction pressure Pc" and insert therefore -- suction pressure Ps --;

Column 10, line 61, please delete "showing relationship" and insert therefore -- showing the relationship --;

Column 10, line 66, please delete "and the , rotational speed Nc." and insert therefore -- and the rotational speed Nc. --;

Column 11, line 2, please delete ""Δ", "▼" is "▼"" and insert therefore -- "Δ", "▲" is "▲" --;

Column 11, line 4, please delete ""Δ", "♦" is "◊"="▲"" and insert therefore -- "Δ", "▲" is "◊"="◆" --;

Column 11, lines 14-15, please delete "plots and difference" and insert therefore -- plots and the difference --;

Column 11, line 20, please delete "such as characteristic curve" and insert therefore -- such as the characteristic curve --;

Column 11, lines 28 and 44, please delete "characteristic curves" and insert therefore -- characteristic curve --;

Column 11, lines 31 and 46, please delete "the higher" and insert therefore -- a higher --;

Column 11, lines 33 and 48, please delete "curves, difference" and insert therefore -- curves, the difference --;

Column 11, lines 36 and 52, please delete "despite high and low of the" and insert therefore -- despite the high and low value of the --;

Column 11, line 59, please delete "speed Nc much influences" and insert therefore -- speed Nc is much more influential --;

Column 12, line 16, please delete "ratios Dtmax in order" and insert therefore -- ratios Dtmax in the order --;

Column 12, lines 37-38, please delete "that are detected predetermined" and insert therefore -- that is detected a predetermined --;

Column 13, line 10, please delete "that relationship" and insert therefore -- that the relationship --;

Column 13, line 20, please delete "under relationship" and insert therefore -- under the relationship --;

Column 13, line 24, please delete "portion 53" and insert therefore -- portion 63 --;

Column 13, line 32, please delete "detected predetermined time before," and insert therefore -- detected a predetermined time before, --;

Column 13, line 59, please delete "is predetermined time" and insert therefore -- is a predetermined time --;

Column 14, lines 14-15, please delete "is predetermined time" and insert therefore -- is a predetermined time --;

Column 15, line 1, please delete "detector 83 provider" and insert therefore -- detector 83 provides --;

Column 15, line 2, please delete "the ECU 61" and insert therefore -- the ECU 81 --;

Column 15, line 23, please delete "in a stat" and insert therefore -- in a state --;

Column 15, line 43, please delete "detected predetermined time" and insert therefore -- detected a predetermined time --;

Column 15, line 48, please delete "In this state. In" and insert therefore -- In this state, in --;

Column 16, line 6, please delete "information f the rotational speed" and insert therefore -- information of the rotational speed --;

Column 16, line 31, please delete "is configures" and insert therefore -- is configured --; and Column 16, lines 46-47, please delete "double headed piston" and insert therefore -- double-headed piston --.

In the Claims

In Claim 13, Column 18, lines 53-54, please delete "at the detecting stop" and insert therefore -- at the detecting step --.

Signed and Sealed this

Twenty-sixth Day of January, 2010

David J. Kappos

David J. Kappos
*Director of the United States Patent and Trademark Office*